United States Patent [19]

Hamilton

[11] 3,990,287

[45] Nov. 9, 1976

[54] BALL PRODUCING MACHINE

[76] Inventor: Harlan M. Hamilton, Star Rte. Box 117, Anthony, Tex. 88021

[22] Filed: Jan. 22, 1976

[21] Appl. No.: 651,612

[52] U.S. Cl. ..... 72/93

[51] Int. Cl.[2] ..... B21H 1/14

[58] Field of Search ..... 72/91, 93, 80, 89

[56] References Cited

UNITED STATES PATENTS

| | | | |
|---|---|---|---|
| 1,913,359 | 6/1933 | Bradley | 72/93 |
| 2,700,908 | 2/1955 | Bockting | 72/93 |

*Primary Examiner*—Milton S. Mehr

[57] ABSTRACT

The disclosure relates to a ball producing machine primarily for producing spherical balls of metal; the machine having a rotor with an annular groove therein and a plurality of individual arcuate sections having conforming annular grooves therein moveable toward and away from the rotor and a hydraulic cylinder at the juncture of adjacent segments; the cylinder having a bar with two bearing portions fitted in adjacent recesses at adjacent end portions of the segments and a hydraulic accumulator communicating with said hydraulic cylinders and adapted to provide resilient yieldability of said segments to accommodate uneven features of pieces of steel as they pass in the grooves between said rotor and said segments.

10 Claims, 7 Drawing Figures

10
12
14
16
26
28
30
32
34
84
86
132
134
136
140
162
164
166
168
170
172
174
176
178
180
182
183
184
186
188
190
192
194
196
198
200
202
204
206
208
210

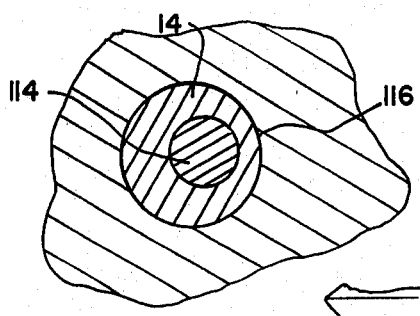
FIG.4.
FIG.3
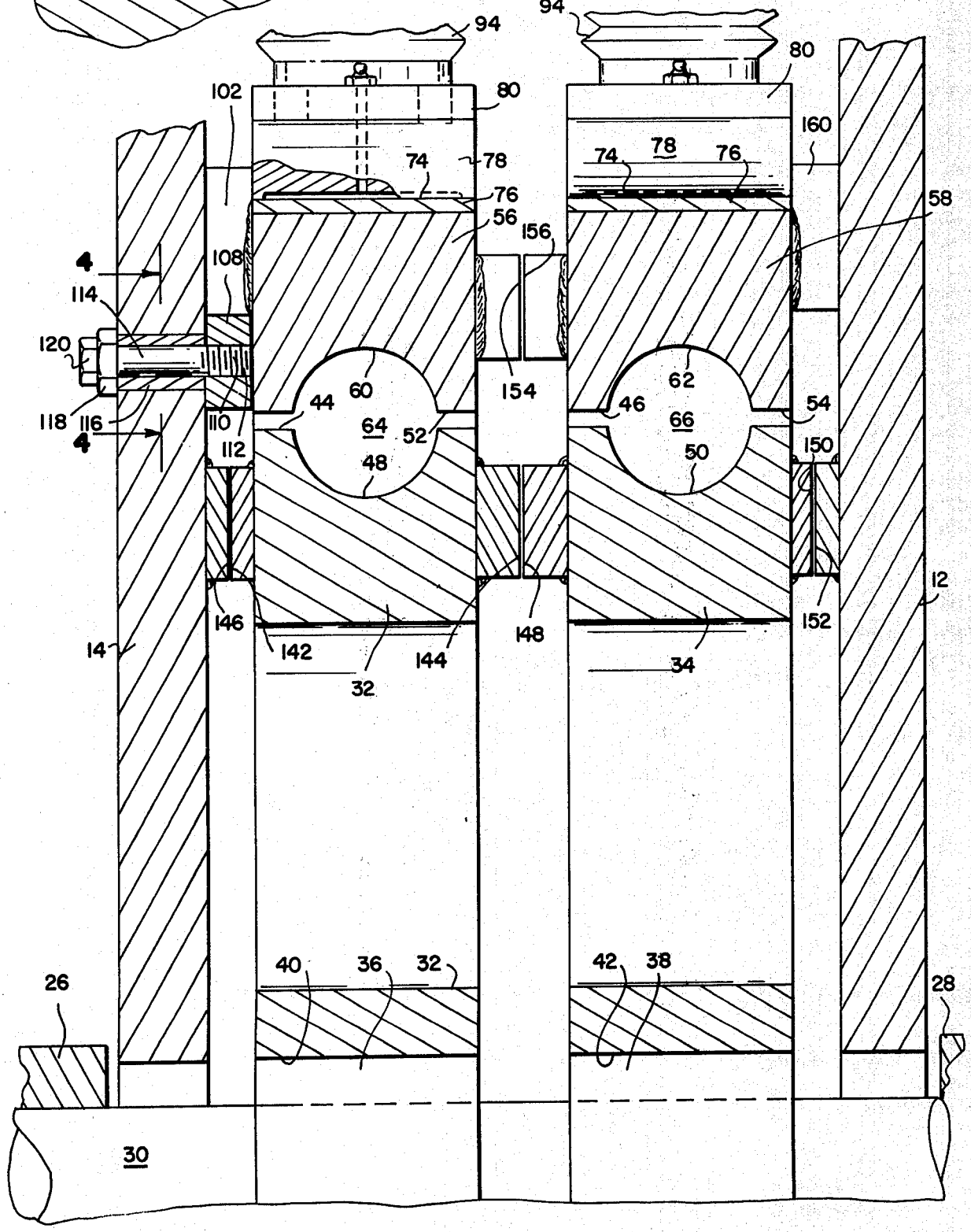

BALL PRODUCING MACHINE

BACKGROUND OF THE INVENTION

Various ball producing machines have been operated to produce balls from chunks of metal, such as steel or the like, and have employed rotors with annular grooves in the peripheries thereof and having die segments surrounding the rotors and having conforming grooves therein and the segments have been forced toward the rotor by means of heavy springs and generally these springs have been made of metal. During operation of such machines, the heat generated in the operation of forming steel balls causes gradual relaxation of the springs and attendant functional capabilities of the machine. Accordingly, conventional ball producing facilities, using springs to hold the die segments toward the periphery of the rotor, have caused considerable maintenance difficulties due to gradual relaxation of the springs and attendant inefficiency in the ball forming operations of the machine.

SUMMARY OF THE INVENTION

The present invention relates to a ball producing machine which may be used to form round or spherical balls from chunks of steel and the machine is provided with a circular rotor having a peripheral portion provided with generally semi-circular in cross section grooved structure therein, adjacent to which die segments are disposed; the die segments being arcuate and having semi-circular in cross section groove portions adjacent the semi-circular in cross section groove of the rotor. The die segments have adjacent ends provided with pressure bearing portions near said ends and hydraulic cylinders are provided with pressure bars coupled to their plungers and the pressure bars are provided with a pair of pressure bearing portions engaging the bearing portions adjacent the ends of the segments; and a hydraulic pressure accumulator is coupled to the hydraulic cylinders so as to provide resilient yeildability of the plungers in the hydraulic cylinders to thereby allow the die segments some freedom of movement relative to the periphery of the rotor so that uneven features of pieces of metal being formed into balls may be gradually formed into a spherical shape.

The pressure bearing portions on said bar coupled to the plunger of each cylinder is engaged in conforming recesses in the adjacent ends of the die segments so as to provide positive holding of the die segments in certain spaced relation at the adjacent ends and also to provide for the application of force to the die segments in a direction toward the axis of the rotor. The die segments are also provided with means slideably interconnecting them to move relative to each other in a direction about the periphery of said rotor but to prevent them from moving individually in a direction radially with respect to the rotor. The pressure bearing means coupled to the plungers of the cylinders, have said pressure bearing portions in fixed position relative to each other; and the conforming pressure bearing recesses in the segments being such as to allow limited movement of the ends of the die segments relative to each other so that the overall assembly of die segments in a generally circular arrangement may expand slightly and contract slightly in a radial direction during the forming of balls in the respective semi-circular in cross section grooves in the rotor and in the die segments. The machine of the invention is provided with a frame having means adapted to restrain movement of the assembly of die segments in a direction of rotation of the rotor so that the assembly of die segments is maintained in stationary position while the rotor continues to rotate, and whereby the assemblies of die segments are substantially less than 360° around the rotor so that metal pieces may be fed into the open receiving end of one of the grooves of one of the die segments and whereby ball shaped parts may emerge from an open end of the semi-circular in cross section grooves at the end of an assembly of die segments and whereby a conduit may extend from the outlet of a first semi-circular in cross section groove and segment assembly to a like second annular groove in the rotor and a comparable set of die segments such that pieces of metal may progress through the first groove in the rotor and respective die segments to the second groove in the rotor and second set of die segments for providing complete spherical formation of pieces of metal introduced into the machine.

Accordingly, it is an object of the present invention to provide a new and novel ball producing machine having a rotor with a semi-circular groove therein and a plurality of arcuate segments surrounding the rotor and having corresponding semi-circular grooves therein and having hydraulic cylinder means actuating said die segments toward said rotor with an accumulator coupled to the hydraulic cylinders and providing resilient yeildability of said segments to accomodate uneven features of pieces of steel being formed into balls between the segments and the rotor.

Another object of the invention is to provide a ball producing machine having pressure bearing means coupled to a hydraulic cylinder plunger and located at the juncture of die segments of the machine such as to apply even pressure on adjacent ends of the individual die segments in a direction radially toward a central axis of the rotor of the machine.

Another object of the invention is to provide novel means for guiding and supporting a plurality of adjacent die segments around the rotor of the ball forming machine.

Further objects and advantages of the invention may be apparent from the following specification, appended claims and accompanying drawings.

BRIEF DESCRIPTION OF THE DRAWINGS

FIG. 3 is an enlarged fragmentary sectional view taken from the line 3—3 of FIG. 1;

FIG. 4 is an enlarged fragmentary sectional view taken from the line 4—4 of FIG. 3;

DESCRIPTION OF THE PREFERRED EMBODIMENTS

Figure 1:
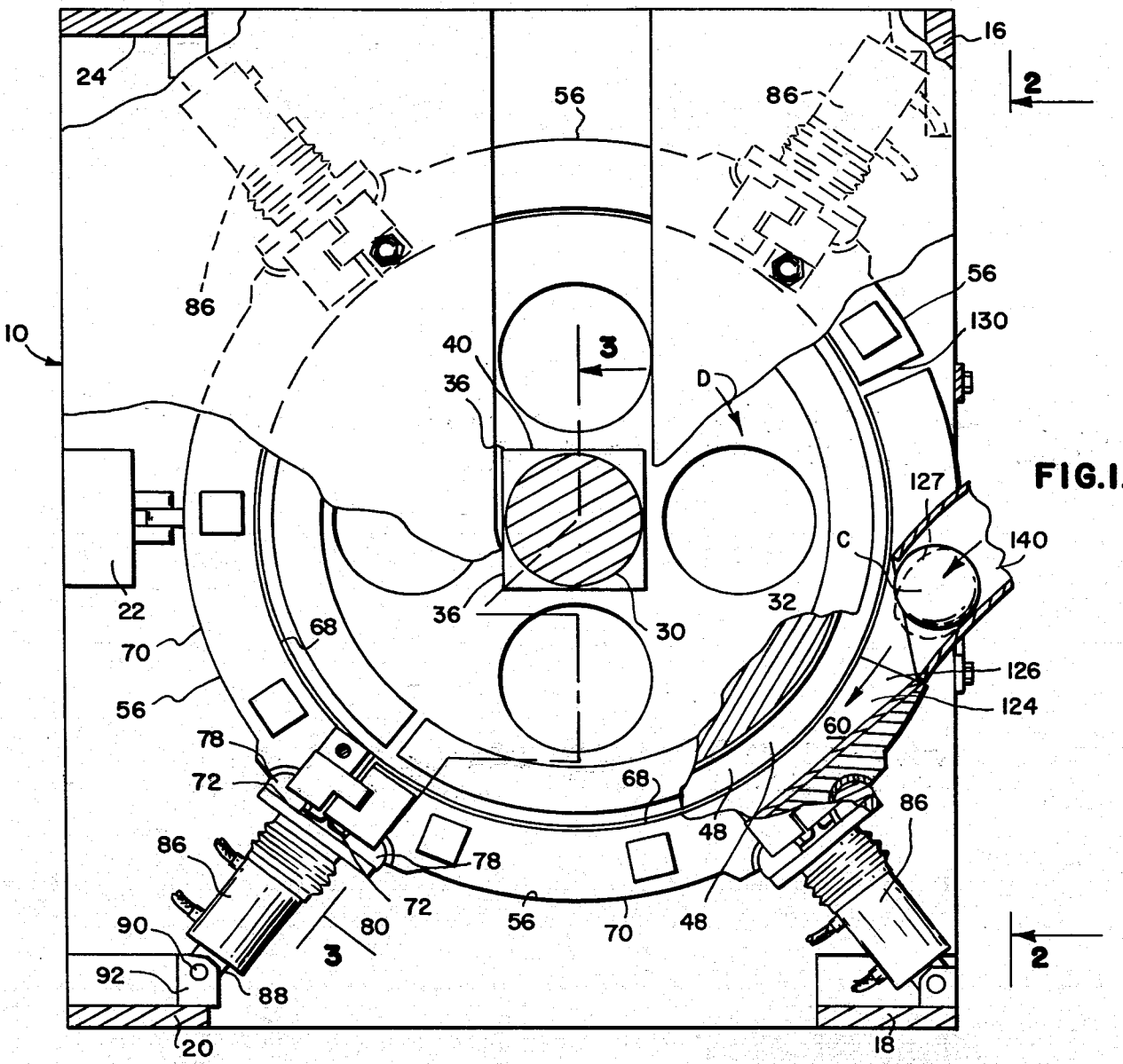
FIG. 1 is a side elevational view of a ball producing machine in accordance with the present invention and showing portions thereof broken away and in section to ampliphy the illustration.
Figures 2, 6, 7:
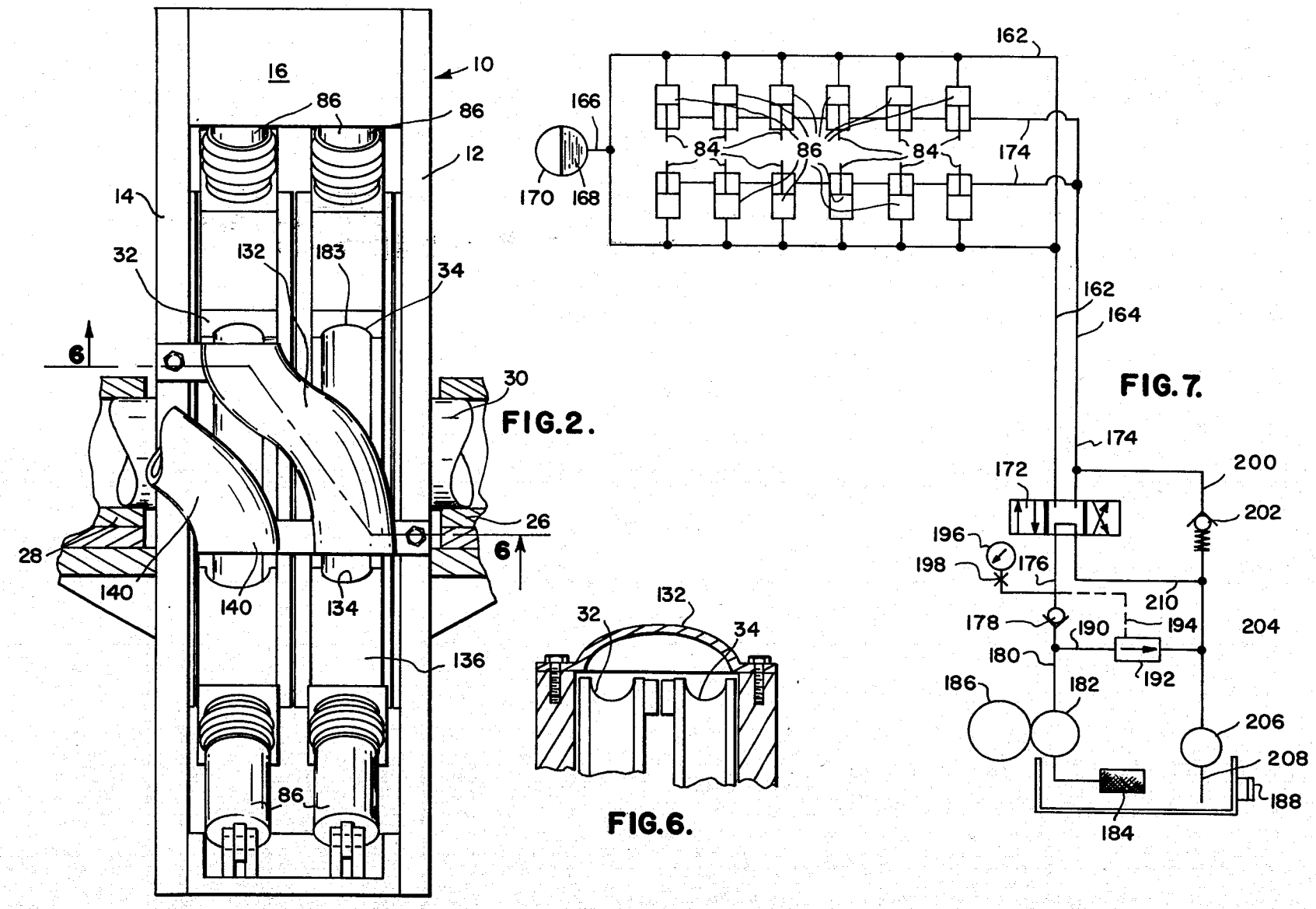
FIG. 2 is a view taken from the line 2—2 of FIG. 1 showing parts and portions fragmentarily to facilitate the illustration.
FIG. 6 is a fragmentary sectional view taken from the line 6—6 of FIG. 2.
FIG. 7 is a view diagramatically illustrating the hydraulic die actuating system of the invention.

As shown in FIGS. 1 and 2 of the drawings, the ball producing machine of the invention is provided with a frame 10, having a pair of side plates 12 and 14 interconnected by frame members 16, 18, 20, 22 and 24.

Bearings 26 and 28 rotatably support a main shaft 30 on the frame 10 and this main shaft 30 carries a pair of rotors 32 and 34. The shaft 30 is provided with rectangular hub portions 36 and 38 which fit into corresponding rectangular openings 40 and 42 in the rotors 32 and 34 respectively, all as shown best in FIGS. 1 and 3 of the drawings. Thus, the rotors 32 and 34 are keyed onto the shaft 30 and the shaft 30 may be driven by any suitable high torque motor and gear train means as desired for rotating the rotors 32 and 34 about the axis of the shaft 30 for forming metal balls, all as will be hereinafter described in detail.

The rotors 32 and 34 are provided with respective peripheral portions 44 and 46, and recessed in these peripheral portions 44 and 46 are respective generally semi-circular in cross section annular grooves 48 and 50; these grooves extending all the way around the periphery of the respective rotors. It will be understood that these semi-circular in cross section grooves 48 and 50 are slightly less than 180° to provide relative clearance between the running periphery 44 and 46 relative to corresponding arcuate portions 52 and 54 of die segments 56 and 58 respectively, all of which will be hereinafter described in detail. The die segments 56 and 58 are provided with generally semi-circular in cross section grooves 60 and 62 respectively which are arcuate grooves generally conforming to the grooves 48 and 50 respectively so as to provide a generally circular in cross section channel; the grooves 48 and 60 defining a substantially circular in cross section channel 64 and the grooves 50 and 62 forming a substantially circular in cross section channel 66, all as shown best in FIG. 3 of the drawings. It will be understood that the semi-circular in cross section grooves 60 and 62 may be slightly less than 180° so as to provide the aforementioned clearance between the peripheries 44 and 46 and the corresponding arcuate portions 52 and 54 respectively, all as hereinbefore described. Inasmuch as the die segments 56 and 58 are similar in construction, the die segments 56 will be hereinafter described in detail.

Figure 5:
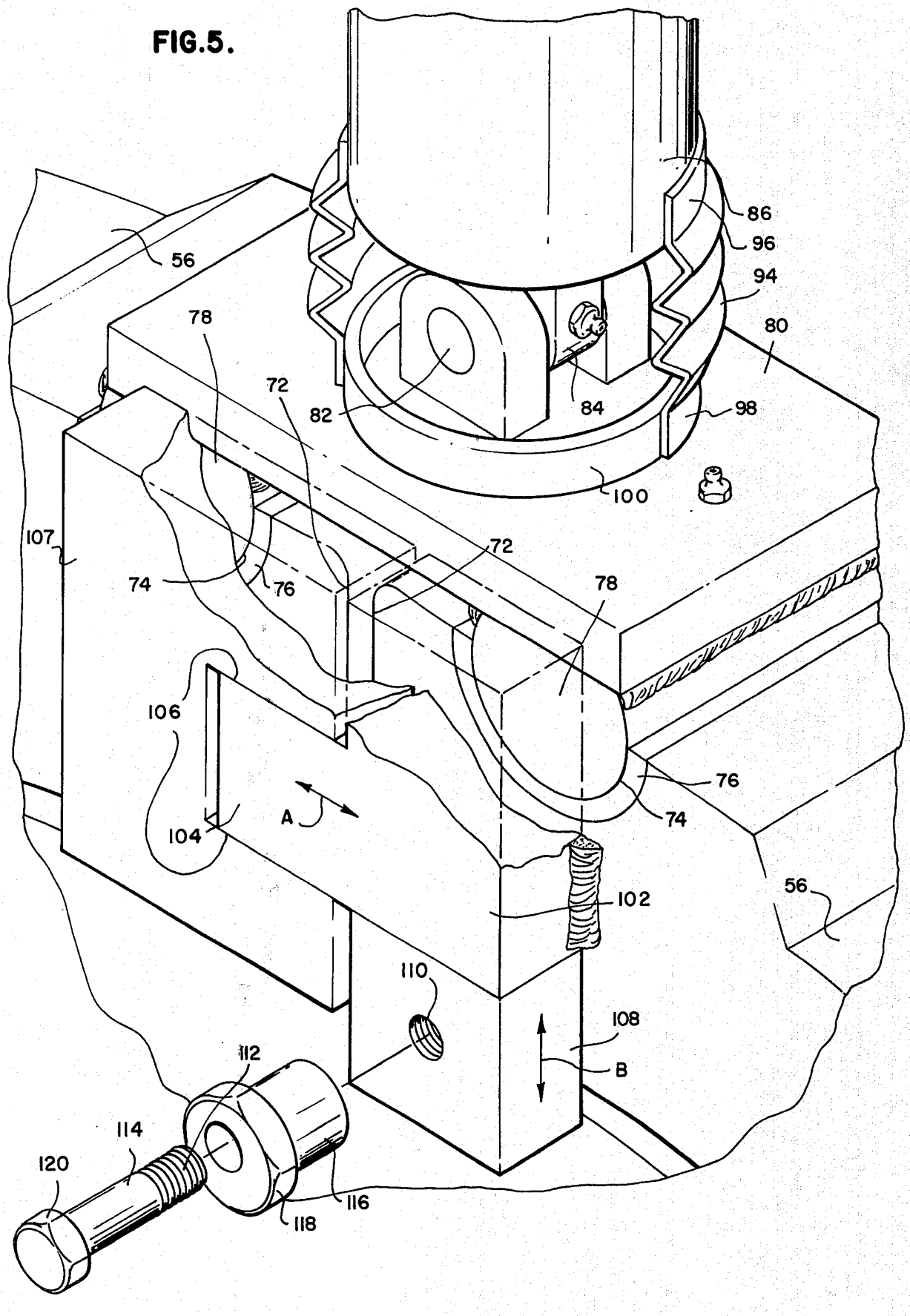
FIG. 5 is an enlarged fragmentary perspective view of one of the hydraulic actuating cylinders showing it with pressure bearing means engaged at adjacent ends of a pair of die segments of the machine and further showing parts and portions in exploded relationship to each other.

Each of said segments 56 is provided with a concave portion 68 in which the respective semi-circular in cross section groove 60 is disposed, all as shown best in FIGS. 1 and 3 of the drawings. Each die segment 56 is provided with an outer portion 70 facing radially outward from the respective concave portion 68 and, as shown in FIGS. 1 and 5 of the drawings, the die segments 56 are provided with adjacent ends 72 which are slightly spaced from each other and near these ends 72 are bearing recesses 74 which are generally arcuate recesses facing outwardly toward the outward surface 70 of each respective die segment. These bearing recesses 74 are provided with hard liners 76 which may be composed of stellite or other suitable material. Arcuate in cross section pressure bearings 78 are engaged in the recesses 74 and a pair of these pressure bearings 78 is fixed to a bar 80 which is pivotally coupled by means of a clevace pin 82, an eye 84 of a plunger of a respective hydraulic cylinder 86. Each hydraulic cylinder is provided with a mount bearing 88, such as shown in FIGS. 1 and 5 of the drawings, and a pivot pin 90 is extended through the respective mount 88 of each cylinder and also through an anchor mount 92 coupled to the frame 10 of the machine.

A dust shield 94 of a generally cylindrical accordian type is provided with a collar 96 engaging a cylinder 86 and another collar 98 engaging a circular member 100 on the bar 80 so as to exclude foreign matter from the area around the pin 82 and the cylinder plunger end member 84.

The ends 72 of the die segment 78 together with the bar 80 and cylinder 86, coupled to the frame 10 by the pin 92 is a typical arrangement of the actuating hydraulic cylinder, all of which are referenced 86 in FIG. 1 of the drawings, there being 4 of these cylinders shown and all operating substantially in the same manner.

Referring to FIG. 5, it will be seen that the pressure bearing members 78 are generally arcuate in cross section and straddle the juncture of the die segments which is represented by the spaced apart end 72, shown in FIG. 5 of the drawings and it will be seen that the bearing recess structures 74 may be of a slightly larger radius than the periphery of each pressure bearing 78 so as to allow the die segments 56 to move toward and away from each other at the adjacent end 72 and with respect to the pressure bearing 78 in accordance with the operation of the mechanism as will be hereinafter described.

Secured to one of the segments 56 is a guide plate 102 having an end portion 104 which fits in a slot 106 and allows the die segments to move toward and away from each other in the direction of the double ended arrow A, as shown in FIG. 5 of the drawings, but does not allow the ends of the die segments 56 at their juncture with each other to move in a direction relative to each other radially with respect to the rotors 32 and 34. Thus, the die segments 56 may move toward and away from each other at their adjacent end 72 in directions as indicated by double ended arrow A, but may not move relative to each other in a direction at right angles to the arrows A at the ends 72 which form a juncture straddled by the respective pair of pressure bearings 78, fixed to the bar 80.

Engaging each guide member 102 is a stop block 108 having an internally screwthreaded hole 110, screwthreadably engageable by a screwthreaded end 112 of a bolt 114; the bolt 114 extending through an eccentric sleeve 116, having a hexagonal wrench engaging head 118 thereon.

With reference to FIG. 4 of the drawings in relation to FIG. 5 of the drawings, it will be seen that the eccentric sleeve 116 is rotatably mounted in the frame plate 14 and that the bolt 114, as shown in FIG. 3 of the drawings, is provided with a head 120 which clamps against the hexanonal end 118 of the eccentric bushing 116 so that the stop member 108 may be clamped in various positions and adjustably moved to such positions in accordance with the double ended arrow B in FIG. 5 of the drawings, whereby the stop 108 may be set to a postion at which the guide member 102 is engaged therewith such that it holds the arcuate portion 68 of the die segments 56 in slightly spaced relation to the periphery 44 of the respective rotor 32. This relationship can be readily seen in FIG. 3, wherein, the guide member 102 bears against the stop member 108 and prevents the concave portion 52 of the respective die segment 56, from dragging on the periphery 44 of the respective rotor 32. Thus, as hereinbefore described, the semi-circular in cross section recesses 48 and 60 of the rotor 32 and die segments 56 are slightly less than 180° of semi-circular structure so that clearance may be had between the die segments and the periphery of the rotor as may be established by the eccentric adjustment of the eccentric member 116 about the axis of the bolt 114 to thereby establish the radial position of the member 180, all as hereinbefore described. It will be seen that the guide member 102 is fixed to one of the die segments 56 while the guide member 107, having the slot 106 therein, is fixed to the adjacent die segment 56. Thus, actuation of the hydraulic cylinder plunger 84 in a radial direction toward the axis of the rotor shaft 30, causes the die segments 56 to tend to move toward each other at their ends 72 and to cause the guide portion 104 to slide in the slot 106 and to thereby allow the arcuate surfaces 52 of the segments 56 to move toward the periphery 44 of the rotor 32 and to thereby move the semi-circular in cross section recesses 60 of each die segment 56 toward the semi-circular in cross section groove 48 in the periphery of the rotor 32 and to thereby place these recess portions of semi-circular cross section into registry with each other so as to correspond with a 360° dispostion of geometry, such that metal parts being rolled between the rotor and the die segments in the corresponding semi-circular in cross section grooves, will be formed into a spherical shape.

One of the die segments 56, as shown in FIG. 1 of the drawings, is provided with a deverging inlet groove portion 124 adjacent an open end 126 of the respective circular in cross section groove portion 60. The open end 126 is thus greater than the corresponding cross section of the semi-circular in cross section groove 60, as shown in FIG. 3 of the drawings. This is due to the divergence of this groove 60 toward the end 126 so as to allow the entrance of irregular pieces of metal designated 127 in FIG. 1, such that these irregular pieces of metal may enter the diverging portion 124 of the respective semi-circular in cross section groove portion 60 and be fed into a position within the semi-circular in cross section annular groove 48 of the rotor 32 so that these irregular pieces of metal may be moved in the direction of an arrow C in FIG. 1 of the drawings with respect to the die segments 56 by rotation of the rotor 32 in the direction of an arrow D in FIG. 1 of the drawings.

One of the die segments 56 is provided with an outlet end 130 and this outlet end 130 is spaced from the inlet end 126 of the hereinbefore described die segment 56. The outlet end 130 communicates with a transfer conduit 132 which extends to an inlet 134 of a die segment 136 surrounding the rotor 34; the die segment 136 is similar to the die segment 56 and the generally assembly of die segments around the rotor 34 is similar to the die segments 56 hereinbefore described. Also the actuating cylinder 86 is similar, as shown in FIG. 1 and 2 of the drawings.

The conduit 132 receives partially formed balls from the outlet 130 of the die segment 56 shown in FIG. 1 and transfers them to the inlet 134 of the die segment 56, which corresponds to the die segment 56, having the diverging open end 126.

The balls, after passing through the conduit 132, pass around the periphery of the rotor 34 and exit from the open end 138 of one of the die segments 136 and as indicated by an arrow J, the balls are delivered from the machine and may be received in any suitable receiver, and at this point the balls are, to all practical purposes, spherical.

An inlet conduit 140, shown in FIG. 2 of the drawings, is provided to conduct the pieces of metal 126 into the receiving end 126 of the receiving die segment 56, as all hereinbefore described in connection with FIG. 1 of the drawings.

The rotor 32 is provided with ring-shaped slide bearings 142 and 144, on its opposite sides. The ring-shaped bearing 142 is engageable with a corresponding ring-shaped bearing 146 carried by the frame member 14. The ring-shaped bearing 144 runs adjacent to a ring-shaped bearing member 148 carried on one side of the rotor 34 while the opposite side thereof carries a ring-shaped bearing 150 which runs adjacent to a ring-shaped bearing 152 carried by the frame member 12. Thus, the rotors 32 and 34 are maintained in relative alignment with the die segments 56 and 58.

The die segments 56 are provided with bearing shoes 154 which are disposed adjacent to bearing shoes 156 coupled to the die segments 58 and a guide member 160 corresponds to the guide member 102 and thus, is disposed between the die segments 58 and the frame member 12 while the guide member 102 is disposed between the die segments 56 and the frame member 14, all of which maintains the respective die segments in substantial alignment with the respective rotors.

Reference is hereby made to the hydraulic system, shown in FIG. 7 of the drawings.

The hydraulic cylinders 86 are each coupled to a high pressure hydraulic fluid conduit 162, adapted to supply pressure to the hydraulic cylinders 86 and to extend the plungers 84 in a direction to cause the bar A and pressure bearing 78 to exert with the force inwardly on the bearing recesses 74 to force the die segments 56 toward the axis of the rotor 32; it being understood that the same function applied to the cylinders 86 forcing the die segments toward the periphery or the axis of the rotor 34. These cylinders are also coupled to the conduit 162 by means of a conduit 164. The conduits 162 and 164 are coupled to a conduit 166 which communicates with a fluid pressure accumulator 168 having a pneumatic pressure chamber portion 170 providing for resilient yeildability of the hydraulic system and also to permit the plungers 84 of the hydraulic cylinders 86 to yeild when irregular pieces of steel are being formed into balls between the semi-circular groove 48 in the rotor 32 and the corresponding semi-circular groove 60 in the die segments 56.

A manual four way valve 172 controls flow of hydraulic hydraulic fluid through the conduit 162 and also through a conduit 174 which communicates with the rod side of the hydraulic cylinders 86 and the fluid in the conduit 174 is at low pressure, as for example 30 PSI as compared to 1000 PSI in the conduit 162. The fluid pressure in the conduit 174 is for the purpose of preventing dirt from entering the cylinder around the rod and also to maintain seal pressure for holding the seals in proper condition.

Communicating with the conduit 162 directly through the valve 172 is a conduit 176, communicating with a one way check valve 178 which allows flow only in a direction from the valve 178 toward the valve 172. Communicating with the check valve 178 at its inlet side is a conduit 180 which communicates with a pump 182 driven by a motor 186. The pump 182 has an inlet 184 in a hydraulic sump 188; communicating with the pump 180 is a by-pass conduit 190 which communicates with an unloading valve 192, having a pilot conduit 194 in communication therewith. This pilot conduit communicates with the conduit 176 at the outlet side of the check valve 178. Also communicating with the conduit 176 is a pressure guage 196 and a guage shut-off valve 198.

Communicating with the low pressure hydraulic conduit 174 is a conduit 200 which communicates with the outlet of a check valve 202 which permits flow only in a direction from the conduit 200 to a conduit 204 which communicates with a fluid filter 206, having an outlet 208 communicating with the hydraulic sump 188.

A by-pass conduit 210 communicates with a four-way valve 172 and also with the conduit 204, so that fluid pressure in the conduits 162 and 174 may be relieved and conducted into the return line or conduit 204 and back to the sump 188.

In operation, when the hydraulic system is energized, motor 186 operates the pump 182 which builds up pressure and passes fluid through the check valve 170 until fluid pressure in the conduit 162 and accumulator 168 is at a desired value as for example 1000 PSI, and at this time the pilot tube 194 communicating with the conduit 176, actuates the pilot valve 192 and allows the output of the pump from the conduit 180 to pass through the unloading valve 192 and to return the output of the pump to the sump 188 via the filter 206 and outlet tube 208. At this time, the check valve 178 holds pressure in the conduit 162 and accumulator 168 and the compressible fluid in the area 170 of the accumulator 168 provides for resilient action of the plungers 84 in the cylinders 86, occasioned by uneven pieces of metal passing between the rotors and die segments of the machine, as such pieces are being rolled into spherical shapes. In accordance with the foregoing, it will be appreciated that the hydraulic cylinders take the place of the usual springs in machines of this type and pressure of the plungers of the cylinders acting on the die segments, hereinbefore described, may always be adjusted to a constant pressure as compared to the usual situation with springloaded die segments where the springs become fatigued. Additionally, the bearing recesses 74 are engaged by a pressure bearing 78 and these bearing recesses 74 are lined with a hardened material such as stellite; and also the set of circular in cross section grooves 48 and 60 of the rotor 32 and the die segments 56 are also lined with a similar layer of stellite or other hard material such that substantial pressure may be exerted by the hydraulic cylinders on the die segments for efficiently rolling pieces of metal into spherical shapes and with the compressible fluid 170 in the accumulator 168, the hydraulic cylinders are so charged that the plungers therein are capable of resilient yeildability, all of which provides efficient operation with a constant die segment force and without the problems attendent to the aforementioned prior art spring relaxation.

It will be obvious to those skilled in the art that various modifications may be resorted to without departing from the spirit of the invention.

I claim:

1. A ball producing machine comprising: a frame, a motor rotatably mounted on said frame and having an axis of rotation; said motor having an annular peripheral portion provided with an annular semi-circular in cross section groove therein; a plurality of arcuate die segments having semi-circular in cross section grooves therein; each of said segments having a concave portion conforming generally to said periphery of said rotor; each of said segments having an outer portion disposed and spaced radially outward from said concave portion; the semi-circular in cross section grooves in said segments facing said annular semi-circular in cross section groove in said peripheral portion of said rotor such that said grooves of said rotor and segments are disposed and comprise a generally circular in cross section channel into which pieces of steel may be conducted to form said pieces into spherical shapes; said segments having adjacent ends and each segment being free to move toward and away from said peripheral portion of said rotor; said adjacent ends being close together so as to form juncture locations between said adjacent ends of said segments; each of said segments having a bearing recess in said outer portion thereof near each end thereof and near a respective one of said juncture locations; a pressure bar overlying each respective juncture location; said pressure bar having a pair of pressure bearing portions; each one of said pair engaged in a respective bearing recess of one of said segments such that the pressure bearing portions of each pair engage bearing recesses in two adjacent ones of said segments; a hydraulic cylinder having a pressure fluid operated plunger; said pressure bar having an intermediate portion between said pressure bearing portion; said intermediate portion connected to said plunger; and a pneumatically charged hydraulic accumulator communicating with said hydraulic cylinders to provide for pressure of said segments toward said rotor and to provide resilient yieldability of said segments radially outward away from said rotor.

2. The invention as defined in claim 1, wherein: one of said segments being restrained on said frame against movement in a direction of movement of said peripheral portion of said rotor around the axis of said rotor.

3. The invention as defined in claim 1, wherein: said pressure bearing portions, of each pressure bar, engaged in respective ones of said bearing recesses of said segments, tending to resist individual movement of said segments relative to each other in an arcuate direction about the axis of said rotor.

4. The invention as defined in claim 1, wherein: said bearing recesses being arcuate and said pressure bearing portions being arcuate and conforming to said bearing recesses.

5. The invention as defined in claim 1, wherein: said pneumatically charged accumulator providing resilient yieldability of said segments to accommodate uneven features of said pieces of steel as they pass between said segments and said rotors and around the peripheral area of said rotor in said arcuate grooves.

6. The invention as defined in claim 1, wherein: one of said segments is provided with a metal piece receiving open end and wherein the respective groove in said segment is shaped divergingly toward said end so as to readily receive pieces of metal therein; said open end of said last mentioned segment being spaced from the next adjacent segments a substantial distance to allow induction of pieces of steel into said open end of said segments and in the respective groove therein and the groove in said rotor.

7. The invention as defined in claim 1, wherein: said rotor is provided with a second annular groove similar to said first mentioned groove therein; said second annular groove axially spaced from said first annular groove in the periphery of said rotor; a second set of segments similar to said aforementioned segments; said second mentioned segments adjacent said second groove in said rotor; said second segments having second grooves similar to said grooves in said first mentioned segments.

8. The invention as defined in claim 7, wherein: said first and second mentioned segments extending less than 360° around said rotor; and a ball transfer means extending from the outlet end of said grooves in said first mentioned segments to the inlet of the grooves in one of said second mentioned segments.

9. The invention as defined in claim 1, wherein: guide means sideably interconnects said segments at their adjacent ends; said guide means disposed to limit movement of said segments independently of each other in a direction toward the axis of said rotor; said guide means disposed to permit movement relative to each other in directions generally tangential relative to said rotor.

10. The invention as defined in claim 1, wherein: adjustable stop means is disposed to limit movement of said segments into engagement with said peripheral portion of said rotor; said semi-circular in cross section grooves in said rotor and said segments being slightly less than 180° in arcuate cross section to allow the roll forming of balls therein without rubbing said segments against said peripheral portion of said rotor; said adjustable stop means being coupled to said frame.

* * * * *